US007226037B2

(12) United States Patent
Newman

(10) Patent No.: US 7,226,037 B2
(45) Date of Patent: Jun. 5, 2007

(54) SYSTEM FOR ASSURING ENGAGEMENT OF A HYDROMATIC BRAKE ON A DRILLING OR WELL SERVICE RIG

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 351 days.

(21) Appl. No.: 10/925,813

(22) Filed: Aug. 25, 2004

(65) Prior Publication Data

US 2006/0163545 A1 Jul. 27, 2006

(51) Int. Cl.
*B66D 1/50* (2006.01)

(52) U.S. Cl. ..... 254/274

(58) Field of Classification Search ..... 254/217, 254/272, 273

See application file for complete search history.

(56) References Cited

U.S. PATENT DOCUMENTS 4,043,434 A * 8/1977 Braschler ..... 188/296
4,139,891 A * 2/1979 Sheldon et al. ..... 702/9
4,165,863 A * 8/1979 Schreyer ..... 254/277
4,434,971 A * 3/1984 Cordrey ..... 254/273
4,488,708 A * 12/1984 Frye ..... 254/355
4,976,143 A * 12/1990 Casso ..... 73/152.45
5,039,028 A * 8/1991 Svedlund et al. ..... 254/275
5,425,435 A * 6/1995 Gregory ..... 188/77 W
5,713,422 A * 2/1998 Dhindsa ..... 175/27
5,818,185 A * 10/1998 Freitag et al. ..... 318/432
5,833,156 A * 11/1998 Park et al. ..... 242/289
6,460,941 B1 * 10/2002 Zenzen et al. ..... 303/122.03
6,463,812 B2 * 10/2002 Dubois ..... 73/862.393

* cited by examiner

*Primary Examiner*—Emmanuel M Marcelo
(74) *Attorney, Agent, or Firm*—King & Spalding LLP

(57) ABSTRACT

The present invention provides an automatic system for engaging the hydromatic brake on a drilling rig or a service rig. This system monitors both the hook load and traveling block velocity, and uses an electrical solenoid to activates the hydromatic when either the hook load or rotating drum velocity exceeds a maximum value, requiring hydromatic brake engagement.

40 Claims, 5 Drawing Sheets

BLOCK DIAGRAM OF AUTOMATIC HYDROMATIC BRAKE ENGAGEMENT

SYSTEM FOR ASSURING ENGAGEMENT OF A HYDROMATIC BRAKE ON A DRILLING OR WELL SERVICE RIG

BACKGROUND OF THE INVENTION

This invention relates to rigs used in oil well operations. Although it is primarily directed to service rigs used in the maintenance and overhaul of existing oil wells, it might also be adapted to use in association with rigs for drilling new oil wells.

While the operation of drilling an oil well has long been performed automatically by a drilling rig, there are operations in connection with oil well drilling or oil well servicing which require a great deal of non-productive time and man power. In the case of a drilling rig it is frequently necessary to pull the drill string out of the hole ("tripping out") to replace the bit and to run the drill pipe back into the hole. After an oil drilling rig drills a well and installs the well casing, the rig is dismantled and removed from the site. From that point on, a mobile repair unit, or workover rig, is typically used to service the well. Servicing includes, for example, installing and removing inner tubing strings, sucker rods, and pumps. It is frequently necessary to pull out a string of production pipe to service the well or maintain downhole equipment. In either case this involves a long series of repetitive steps in which joints of pipe are withdrawn from the hole, (one or two or three at a time), disconnected by "breaking out" their threaded ends, and stored while subsequent lengths are withdrawn. The process is repeated in reverse when lengths of pipe are connected ("made up") together and inserted one after another to replace the drill string or the production string in the hole. This is generally done with a cable hoist system that includes a traveling block that raises and lowers the aforementioned tubing strings, sucker rods, and pumps.

While running lengths of pipe, it is obvious that as more and more lengths are run into the hole, the heavier and heavier the string of pipe becomes. This puts an ever increasing strain on conventional brake drums of the cable hoist system, sometimes leading to brake failure or brake inefficiency due to heating while tripping into the hole. Installing disk assist brakes on service rigs delivers the control and safety needed in the well servicing industry. As disk assist brakes are installed on remanufactured rigs, algorithms are being developed to control the speed throughout the range of downward block travel, but these algorithms are not currently being implemented. Because the conventional drum brakes are self energizing, they are difficult to use to finely control downward speeds.

Heat is the brake's worst enemy. As hookloads get heavier and the blocks get faster, more braking action must be applied to control and stop the blocks. Bringing heavily loaded blocks to a stop from fast moving downward motion generates energy that ends up being dissipated as heat. Hot brakes have control issues, resulting in part from band stretching and when the drums get out of round. Spraying water on the brake bands is one solution used in the field. As the brakes heat, the rig has a nozzle system that is designed to cool the bands down, however this system has it problems too. Heat and water changes metallurgy and causes corrosion. This can lead to component failure and general brake failure. Therefore, it is incumbent on the drilling and service industry to avoid heating the brakes too much.

Enter the hydromatic or water brake. The hydromatic brake is usually nothing more than a water pump connected to the tubing drum. When the hookload gets high, the hydromatic brake should be engaged to both slow down and control the speed. When engaged, the falling blocks and hookload energy are dissipated into the pumping of water, thereby delaying the tubing drum brake heating. However, while the hydromatic brake system can reduce conventional brake wear, it must be used to be effective. One drawback of the hydromatic is the slowing down of the running speed. When the energy of the downward moving block is transferred to the brake, the rig experiences a loss of freefall and therefore a slowing effect. As a result of this, an operator or driller will not engage the hydromatic until it is needed or mandated by standard operating procedures. If he is in a hurry to trip into the hole, he is more likely to delay the brake engagement. Often times drilling or rig operators will not engage the brake, and thus it would be desirable if an automated system was developed to automatically engage the hydromatic brake when appropriate.

SUMMARY OF THE INVENTION

The present invention provides an automatic system for engaging the hydromatic brake on a drilling rig or a service rig. This system monitors both the hook load and traveling block velocity, and uses an electrical solenoid to activates the hydromatic when either the hook load or rotating drum velocity exceeds a maximum value, requiring hydromatic brake engagement.

DESCRIPTION OF ILLUSTRATIVE EMBODIMENTS

Figure 1:
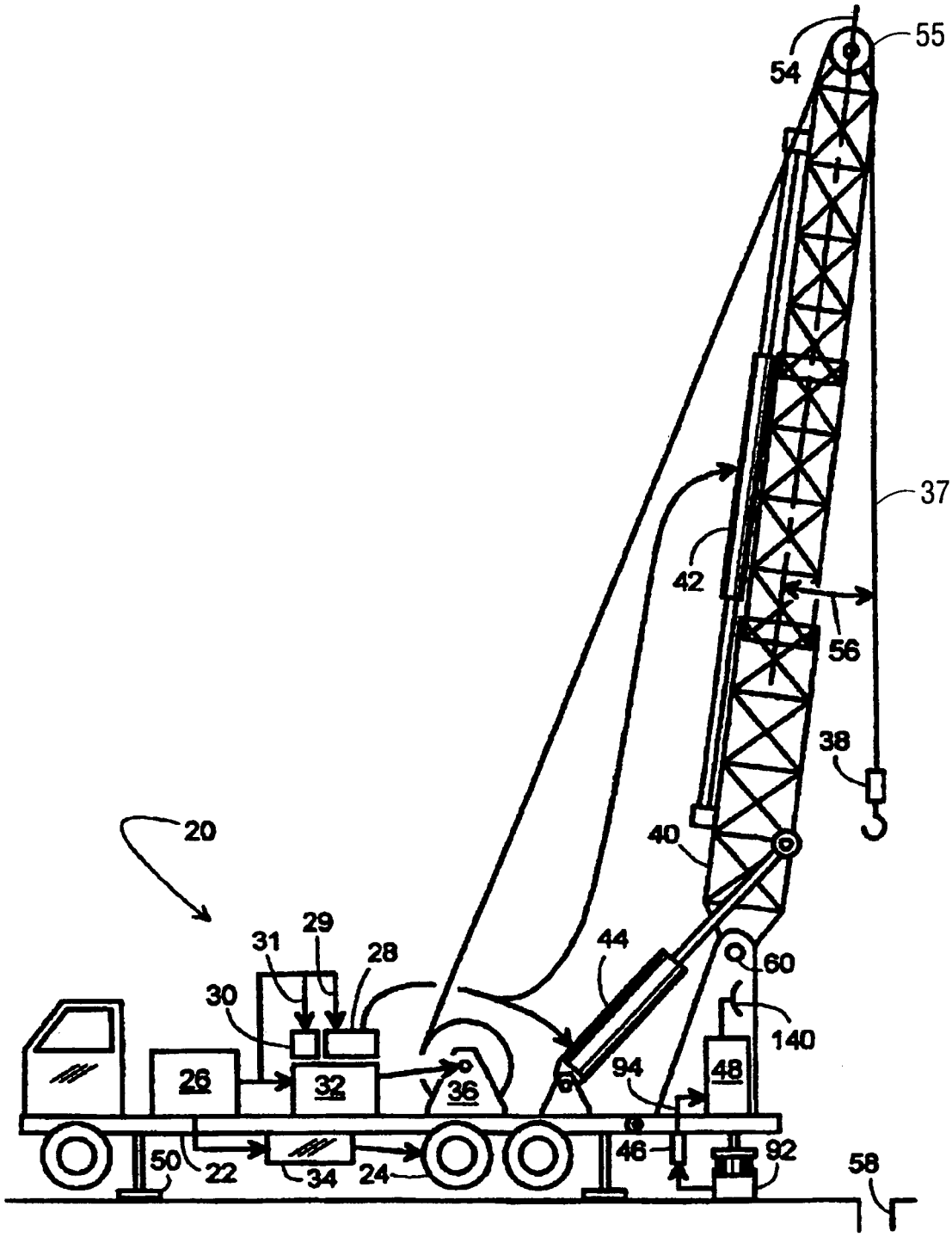
FIG. 1 illustrates one embodiment of a well service rig.

Referring to FIG. 1, a retractable, self-contained workover rig 20 is shown to include a truck frame 22 supported on wheels 24, an engine 26, a hydraulic pump 28, an air compressor 30, a first transmission 32, a second transmission 34, a variable speed hoist 36, a block 38, an extendible derrick 40, a first hydraulic cylinder 42, a second hydraulic cylinder 44, a monitor 48, and retractable feet 50. Engine 26 selectively couples to wheels 24 and hoist 36 by way of transmissions 34 and 32, respectively. Engine 26 also drives hydraulic pump 28 via line 29 and air compressor 30 via line 31. Compressor 30 powers a pneumatic slip (not shown), and pump 28 powers a set of hydraulic tongs (not shown). Pump 28 also powers cylinders 42 and 44 that respectively extend and pivot derrick 40 to selectively place derrick 40 in a working position (FIG. 1) and in a retracted position (not shown). In the working position, derrick 40 is pointed upward, but its longitudinal centerline 54 is angularly offset from vertical as indicated by angle 56. This angular offset 56 provides block 38 access to a well bore 58 without interference from the derrick framework and allows for rapid installation and removal of inner pipe segments, such as inner pipe strings and/or sucker rods.

When installing inner pipe segments, the individual pipe segments are screwed together using hydraulic tongs (not shown). Hydraulic tongs are known in the art, and refer to any hydraulic tool that can screw together two pipes or sucker rods. During make up operations, block 38 supports each pipe segment while it is being screwed into the downhole pipe string. After that connection, block 38 supports the entire string of pipe segments so that the new pipe segment can be lowered into the well. After lowering, the entire string is secured, and the block 38 retrieves another pipe segment for connection with the entire string. Conversely, during breakout operations, block 38 raises the entire string of pipe segments out of the ground until at least one individual segment is exposed above ground. The string is secured, and then block 38 supports the pipe segment while it is uncoupled from the string. Block 38 then moves the individual pipe segment out of the way, and returns to raise the string so that further individual pipe segments can be detached from the string.

Referring back to FIG. 1, weight applied to block 38 is sensed, for example, by way of a hydraulic pad 92 that supports the weight of derrick 40. Generally, hydraulic pad 92 is a piston within a cylinder, but can alternatively constitute a diaphragm. Hydraulic pressure in pad 92 increases with increasing weight on block 38, and this pressure can accordingly be monitored to assess the weight of the block. Other types of sensors can be used to determine the weight on the block, including line indicators attached to a deadline of the hoist, a strain gage that measures any compressive forces on the derrick, or load cells placed at various positions on the derrick or on the crown. While the weight of the block can be measured in any number of ways, the exact means of measurement is not critical to the present invention, however it is important that the weight on the block is measured.

Hoist 36 controls the movement of a cable 37 which extends from hoist 36 over the top of a crown wheel assembly 55 located at the top of derrick 40, supporting travelling block 38. Hoist 36 winds and unwinds cable 37, thereby moving the travelling block 38 between its crown wheel assembly 55 and its floor position, which is generally at the wellbore 58, but can be at the height of an elevated platform located above wellbore 58 (not shown).

To determine traveling block velocity, the speed of the rotating drum of hoist 36 must be measured. This can be done using a magnetic pick-up device or other electrical output type sensor is operatively situated adjacent to a rotary part of the cable hoist 36 or crown wheel assembly 55 and produces electrical impulses as the part rotates. Alternatively, a photoelectric device is used to generate the necessary electric impulses. These electrical impulses are conveyed to electronic equipment that can calculate the number of electrical impulses per unit time as they are measured. If a 4-20 device is used to calculate block position, the rate of change of current per unit time would need to be calculated to determine block speed, where the current is the output of the 4-20 encoder. Other methods are just as useful to the present invention, such the use of as a quadrature encoder, an optical quad encoder, or other such devices known in the art. If a pulsed system is used, such as the quadrature encoder or optical encoder, the speed can be calculated by counting the number of pulses per unit time. The means of sensing the velocity of the drum is not important to the present invention, however it is important that the position of the block is measured and known.

Figure 2:
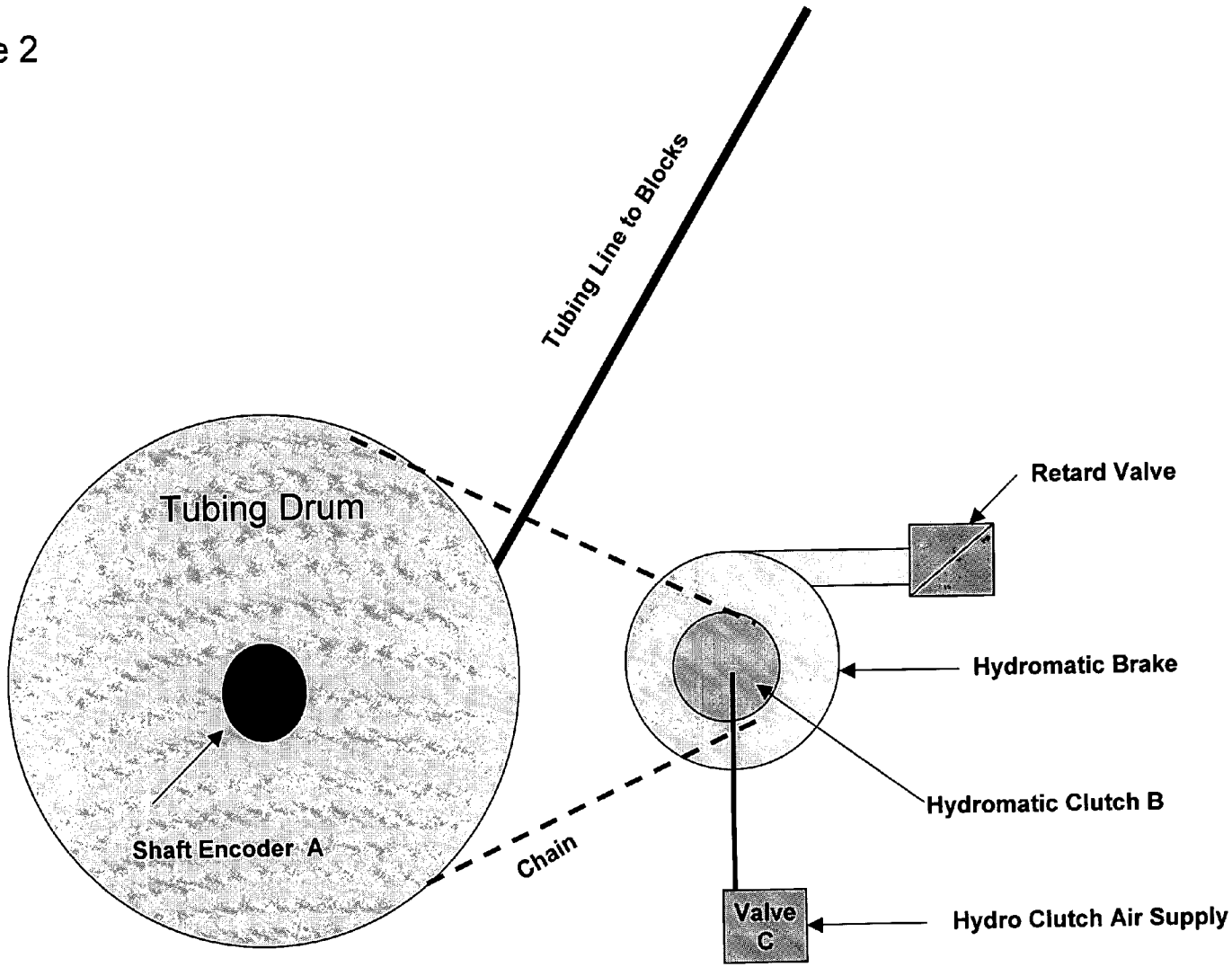
FIG. 2 illustrates a hydromatic brake.

Referring now to FIG. 2, a hydromatic brake is shown. The hydromatic brake on drilling or service rigs is usually nothing more than a centrifugal water pump. This pump may be single stage for a small rig or multistage for larger rigs working with heavy hookloads. There is a large water holding tank on the rig and the suction from the brake draws water from this tank and the output from the pump feeds this water right back into the tank. This brake is directly coupled to the tubing drum via a chain and clutch arrangement. When the hydromatic clutch (B) is engaged, the brake turns in proportion to the tubing drum. When the clutch is not engaged, the brake does not enter the system as the pump does not turn. The total water flow going thru the hydromatic is controlled by both the turning speed of the brake and openness of the retard valve located on the output of the pump.

The purpose of the hydromatic brake is to provide a mechanism for the dissipation of kinetic energy released as the hookload is brought to a smooth stop. This takes part of the braking action task away from the drum brakes and transfers the action to the pump. The hydromatic brake further provides a mechanism for limiting the downward velocity of the hookload and blocks, and also provides a mechanism for obtaining uniformity of braking. This is accomplished by the brake taking a constant HP from the tubing drum. The rig brakes are not perfectly round and are subjected to wear, thereby demonstrating some variance in braking ability for any given brake handle position.

Figure 3:
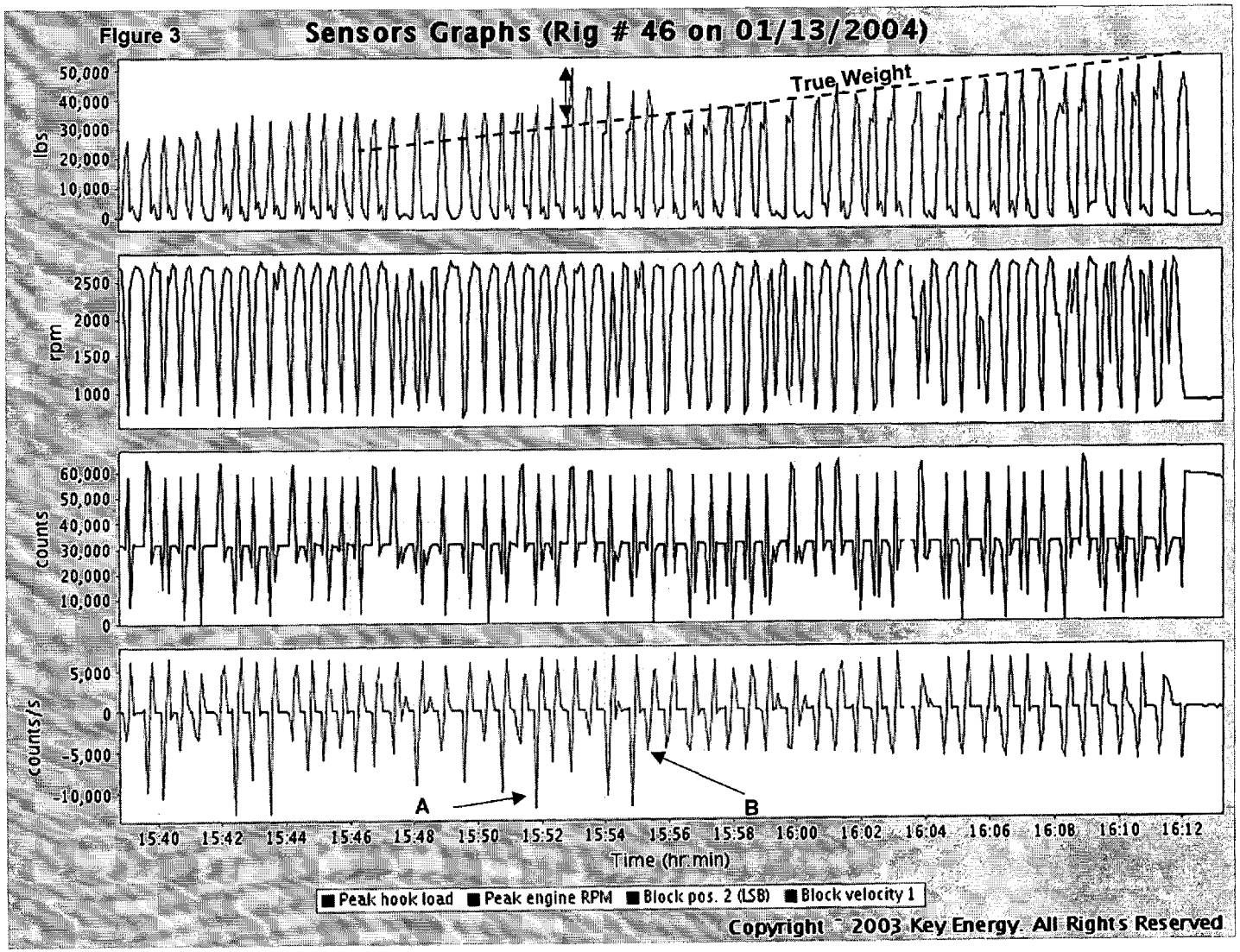
FIG. 3 shows actual hook load and traveling block velocity data illustrating the need for and the result of the present invention.

The need for the hydromatic brake is illustrated in FIG. 3. The first curve is the weight or the hookload being run. This weight information can come from either a line indicator or from the pad indicators as shown in FIG. 1. The weight recorded is the highest (peak) during the sample period. The second curve is the engine RPM. The third curve is a representation of the block height position relative to the upper and lower set points. Zero is the lower set point near the rig floor and the higher readings occur when the blocks are high in the derrick. The scale is in encoder counts. Finally, The fourth curve is representative of the tubing drum rotating velocity or how fast the blocks are being run either up or down. Again, the scale is in raw counts per second coming from the encoder. Roughly, there is 392 counts per revolution of the drum so 3,920 counts per second is the drum turning at 10 rev/second. Note that this curve has a zero line in the center. A positive number is the blocks going up in the derrick and a negative number is the blocks going down and running something into the hole.

The object of any safe driller and or service operator is to run the rig as smoothly as possible and not to subject the rig components and downhole tools (derrick, hoist, drilling lines, tubing, rods, and drillpipe) to stresses beyond design limits. As shown in FIG. 3, at point A, there is an roughly an 18,000 pound difference between the apparent instantaneous hook load of 50,000 pounds and the actual hookload of 32,000 pounds. The rotating velocity of the drum at point A is over 30 RPS (1,800 RPM), which is extremely fast for a rig. This represents an area of improved rig maintenance if the velocity of this drum can be limited.

The instantaneous-apparent weight problem poses the largest threat to equipment and injury. The approximate 18,000 pound increase in apparent weight comes from the force needed to stop a moving object. The faster the stoppage (increased-deceleration) the more the instantaneous weight seen on the rig. It is obvious that if the real hook load is close to tensile yield and the rig runs too fast and stops too fast, the subjected load can exceed the tensile of the tubing or drill pipe being run. When the hydromatic brake is engaged at point B, the instantaneous-apparent weight problem is solved, as is the problem of the high rotating speed of the drum.

Figure 4:
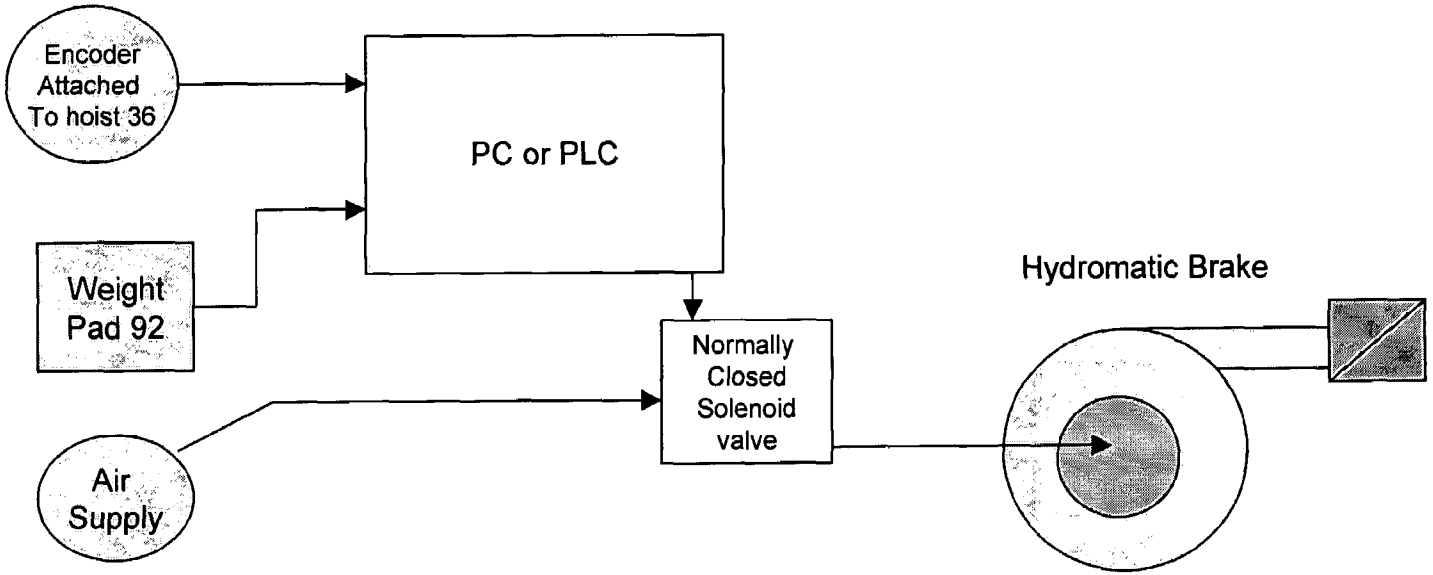
FIG. 4 shows a block diagram of one embodiment of the present invention.

Referring now to FIG. 4, a block diagram of the present invention shows that the encoder reading, measuring the speed of the rotating drum, and the hook load are fed into a computer, PC, PLC, or other electronic controller. Such controllers are well known in the art. The controller is pre-programmed with maximum velocity and maximum weight values, such that once either the encoder reading or weight exceeds these maximum values, the controller sends a signal to a solenoid valve. This solenoid valve is a normally closed solenoid, and when activated, the solenoid valve opens to allow air to activate the hydromatic brake.

Figure 5:
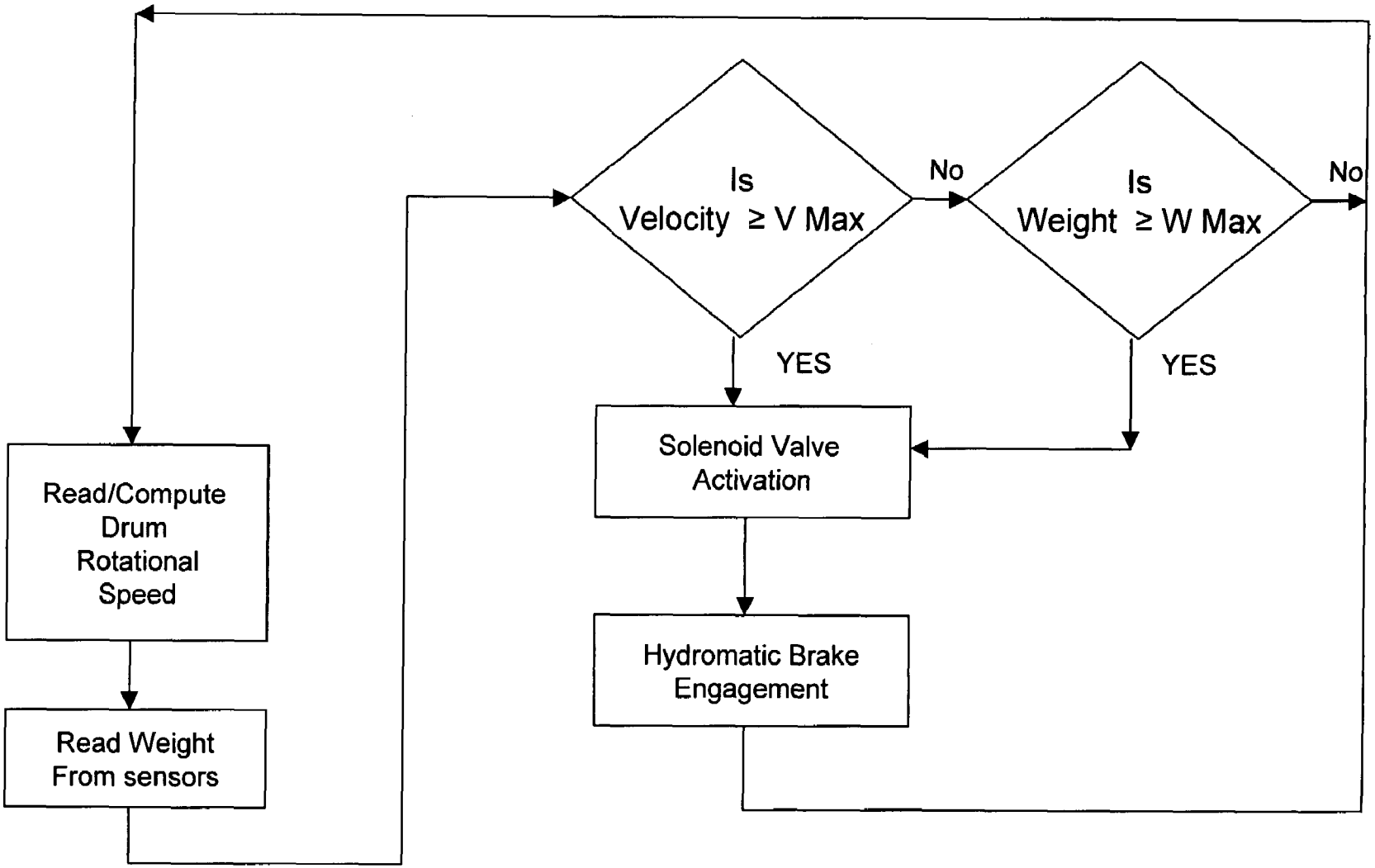
FIG. 5 shows a logic diagram of one embodiment of the present invention.

This concept is further illustrated in FIG. 5, which shows a logic diagram of one embodiment of the present invention. First, the drum rotational speed is determined, followed by determining the hook load. Then, it is determined if the rotational speed is higher than the maximum allowed rotational speed. If so, the solenoid valve is activated and the hydromatic brake engaged. If not, it is determined if the hook load is greater than a predetermined maximum limit. If so, the solenoid valve is activated and the hydromatic brake engaged. If not, then the hydromatic brake is not engaged and the system operates normally.

The hydromatic brake is usually only engaged when the traveling block is moving downward, running into the hole. Therefore, in some embodiments, the hydromatic brake can be automatically disengaged when the traveling block is moving upward. The direction of the traveling block can easily be determined by monitoring the difference in encoder counts. For example, if the total counts are increasing, then the traveling block is moving upward, and the system can automatically disengage the hyromatic brake. If the total counts are decreasing, and the traveling block is moving downward, the hydromatic brake is engaged and ready for service if needed, as described above.

In some embodiments of the present invention, an alarm is activated when the hydromatic brake is automatically engaged to alert the operator of its engagement. This alarm can either be an audible alarm, or can be visual, such as a flashing light.

While the apparatuses and methods of the present invention have been described in terms of preferred embodiments, it will be apparent to those of skill in the art that variations may be applied to what has been described herein without departing from the concept and scope of the invention. All such similar substitutes and modifications apparent to those skilled in the art are deemed to be within the scope and concept of the invention as it is set out in the following claims. For instance, many of the embodiments were described as being useful on well service rigs, however each embodiment is equally useful on standard drilling rigs and other types of oil rigs.

What is claimed is:

1. A process for automatically engaging a hydromatic brake on an oil rig, comprising:

determining the rotational speed of the oil rig drum;

comparing the rotational speed of the oil rig drum to a maximum rotational speed value;

automatically engaging a hydromatic brake if the rotational speed of the oil rig drum exceeds the maximum rotational speed value.

2. The process of claim 1, wherein the rotational speed of the oil rig drum is determined using a device selected from the group consisting of a magnetic pick-up device, a photoelectric device, a 4-20 device, a quadrature encoder, and an optical quad encoder.

3. The process of claim 1, wherein the hydromatic brake is a centrifugal water pump.

4. The process of claim 3, wherein the centrifugal water pump is selected from the group consisting of a single stage pump or a multistage pump.

5. The process of claim 1, further comprising an electronic controller.

6. The process of claim 5, wherein the electronic controller is selected from the group consisting of a computer, a PC, or a PLC.

7. The process of claim 5, wherein the electronic controller is pre-programmed with maximum rotational speed value.

8. The process of claim 7, wherein the electronic controller compares the rotational speed of the oil rig drum to a maximum rotational speed value.

9. The process of claim 1, wherein the hydromatic brake is automatically engaged by activating a solenoid valve that controls air to the hydromatic brake.

10. The process of claim 1, further comprising activating an alarm when the hydromatic brake is automatically engaged.

11. The process of claim 10, wherein the alarm is either audio or visible.

12. The process of claim 1, wherein the oil rig is a drilling rig.

13. The process of claim 1, wherein the oil rig is a well service rig.

14. A process for automatically engaging a hydromatic brake on an oil rig, comprising:

determining the hook load of the oil rig;

comparing the hook load of the oil rig drum to a maximum hook load value;

automatically engaging a hydromatic brake if the hook load of the oil rig drum exceeds the maximum hook load value.

15. The process of claim 14, wherein the hook load rotational speed of the oil rig drum is determined using a device selected from the group consisting of an hydraulic pad, a line indicator attached to a deadline of the hoist, a strain gage that measures compressive forces on the derrick, and load cells placed on the derrick of the oil rig, and load cells placed on the crown of the oil rig.

16. The process of claim 14, wherein the hydromatic brake is a centrifugal water pump.

17. The process of claim 16, wherein the centrifugal water pump is selected from the group consisting of a single stage pump or a multistage pump.

18. The process of claim 14, further comprising an electronic controller.

19. The process of claim 18, wherein the electronic controller is selected from the group consisting of a computer, a PC, or a PLC.

20. The process of claim 18, wherein the electronic controller is pre-programmed with maximum rotational speed value.

21. The process of claim 20, wherein the electronic controller compares the rotational speed of the oil rig drum to a maximum rotational speed value.

22. The process of claim 14, wherein the hydromatic brake is automatically engaged by activating a solenoid valve that controls air to the hyromatic brake.

23. The process of claim 14, further comprising activating an alarm when the hydromatic brake is automatically engaged.

24. The process of claim 23, wherein the alarm is either audio or visible.

25. The process of claim 14, wherein the oil rig is a drilling rig.

26. The process of claim 14, wherein the oil rig is a well service rig.

27. A process for automatically engaging a hydromatic brake on an oil rig, comprising:

determining the rotational speed of the oil rig drum;

determining the hook load of the oil rig;

comparing the rotational speed of the oil rig drum to a maximum rotational speed value;

comparing the hook load of the oil rig drum to a maximum hook load value;

automatically engaging a hydromatic brake if either the rotational speed of the oil rig drum exceeds the maximum rotational speed value or the hook load of the oil rig drum exceeds the maximum hook load value.

28. The process of claim 27, wherein the rotational speed of the oil rig drum is determined using a device selected from the group consisting of a magnetic pick-up device, a photoelectric device, a 4-20 device, a quadrature encoder, and an optical quad encoder.

29. The process of claim 27, wherein the hook load rotational speed of the oil rig drum is determined using a device selected from the group consisting of an hydraulic pad, a line indicator attached to a deadline of the hoist, a strain gage that measures compressive forces on the derrick, and load cells placed on the derrick of the oil rig, and load cells placed on the crown of the oil rig.

30. The process of claim 27, wherein the hydromatic brake is a centrifugal water pump.

31. The process of claim 30, wherein the centrifugal water pump is selected from the group consisting of a single stage pump or a multistage pump.

32. The process of claim 27, further comprising an electronic controller.

33. The process of claim 32, wherein the electronic controller is selected from the group consisting of a computer, a PC, or a PLC.

34. The process of claim 32, wherein the electronic controller is pre-programmed with maximum rotational speed value.

35. The process of claim 34, wherein the electronic controller compares the rotational speed of the oil rig drum to a maximum rotational speed value.

36. The process of claim 27, wherein the hydromatic brake is automatically engaged by activating a solenoid valve that controls air to the hyromatic brake.

37. The process of claim 27, further comprising activating an alarm when the hydromatic brake is automatically engaged.

38. The process of claim 37, wherein the alarm is either audio or visible.

39. The process of claim 27, wherein the oil rig is a drilling rig.

40. The process of claim 27, wherein the oil rig is a well service rig.

* * * * *